United States Patent [19]

Espenscheid et al.

[11] 4,145,188

[45] Mar. 20, 1979

[54] LIQUEFACTION OF SOLID ORGANIC WASTES

[75] Inventors: Wilton F. Espenscheid, Princeton, N.J.; Tsoung Y. Yan, Philadelphia, Pa.

[73] Assignee: Mobil Oil Corporation, New York, N.Y.

[21] Appl. No.: 743,740

[22] Filed: Nov. 22, 1976

[51] Int. Cl.[2] ..... C10L 1/18

[52] U.S. Cl. ..... 44/50; 44/51; 44/60; 44/80

[58] Field of Search ..... 44/50, 80, 66, 51

[56] References Cited

PUBLICATIONS

Inglett, G.E. "Fuel from Agricultural Waste", in Symposium:Processing Agricultural Waste, Chap. 8, pp. 84–92, 1973.

Affell et al. "Conversion of Municipal Refuse to Oil" in Pro. 3rd Annual N. E. Regional Conf. 1970 pp. 225–231.

*Primary Examiner*—Winston A. Douglas
*Assistant Examiner*—Y. Harris-Smith
*Attorney, Agent, or Firm*—Charles A. Huggett; Carl D. Farnsworth

[57] ABSTRACT

This invention provides a method for solubilizing municipal refuse and other solid organic wastes in a highly aromatic refinery petroleum solvent to produce a homogeneous heavy oil or bitumen composition.

8 Claims, No Drawings

LIQUEFACTION OF SOLID ORGANIC WASTES

BACKGROUND OF THE INVENTION

Wood and coal have been a principle source of fuel for hundreds of years. Within the last one hundred years, petroleum has become the overwhelming primary commodity for the generation of energy. Petroleum has had the advantages of low cost and ease of transportation and storage because of its liquid consistency. Further, petroleum is readily amenable to fractionation and conversion into a variety of valuable industrial products such as fuels, building products, chemical intermediates, and the like.

Recent international economic developments have signaled the inevitable decline of petroleum as the world's supreme industrial commodity. The price of raw petroleum has increased several fold. Also, the consumption of petroleum has been increasing exponentially and concomitantly the world petroleum supply has diminished to less than several decades of proven reserves. Governments and industrial concerns on a priority basis are dedicating increased attention to alternatives to petroleum as sources for fuels and chemical intermediates.

It is known that coal and wood can be liquified by controlled heating in the substantial absence of oxygen. The conversion products are a liquid, gas and char. Representative prior art includes U.S. Pat. Nos. 3,379,638; 3,607,718; 3,640,816; 3,642,608; 3,705,092; 3,849,287; 3,870,621; inter alia.

The destructive distillation of wood to produce charcoal, oils and gases is also well known. It has been reported, for example, that as much as two barrels of oil per ton of tree bark can be obtained by a controlled pyrolysis process. The United States Bureau of Mines, in publication Number 8013 entitled "Conversion of Cellulosic Wastes to Oil", reports 90–99 weight percent conversion of sawdust with 40–60 weight percent yields of oil by reaction with synthesis gas at a temperature of 250° C.–425° C. and a pressure of 1500–4000 psig, in the presence of water and an inorganic catalyst.

Also receiving high priority attention is the management of municipal, industrial and agricultural solid organic wastes, for reasons of environmental protection and natural resource conservation.

Techniques developed for lignite and carbohydrate liquefaction are being studied for solid organic waste conversion. Appell et al have reported the production of heavy oil by treatment of municipal solid waste with carbon monoxide and water at 380° C. and 1500 psig pressure (Proc. Of The Nat. Ind. Solid Wastes Management Conference, pages 375–379, March 1970).

U.S. Pat. No. 3,714,038 describes a method of chemically changing solid waste material into useful organic products by pulping a mixture of organic and inorganic wastes in water to form a slurry, removing inorganics from the slurry, dewatering the slurry, and then either pyrolyzing or hydrogenating the dewatered slurry.

U.S. Pat. No. 3,864,096 discloses a process for converting cellulose into a normally liquid oil, which process consists of contacting the cellulose with water, a reducing gas and an ammonia-producing gas at 300°–375° C. and a pressure of 100–150 atmospheres.

Other processes for converting solid organic wastes into fuels and chemical products are described in U.S. Pat. Nos. 3,085,038; 3,910,775; 3,926,582; 3,933,577; and the references cited therein.

New programs are being initiated for the development of technology for the provision of carbonaceous fuel products which complement and enhance conventional petroleum or coal-derived energy sources. Alternate innovative processes are being sought which do not depend on high pressures or reducing gases or catalysts for efficient and economic conversion of materials such as solid organic wastes.

Accordingly, it is an object of the present invention to provide an improved method for converting solid organic waste materials into liquid derivatives having application as fuels and chemical intermediates.

It is another object of the present invention to provide a process for liquefaction of solid waste materials without the use of high pressures or reducing gases or catalysts.

It is another object of the present invention to solubilize cellulosic waste materials such as cardboard and newsprint, grain husks, nut shells, bagasse, and the like, to form flowable heavy oil or pitch-like compositions which are directly applicable as liquid fuels.

It is a further object of the present invention to upgrade low value refractory petroleum residua from refinery operations into liquid fuel media.

Other objects and advantages of the present invention shall become apparent from the accompanying description and illustrative data.

DESCRIPTION OF THE INVENTION

One or more objects of the present invention are accomplished by a process for liquefaction of solid carbohydrate wastes which comprises forming a slurry by admixing comminuted carbohydrate material with a thermally stable refinery petroleum residuum having a boiling point between about 450° F. and 1100° F. and heating said slurry at a temperature in the range between about 350° F. and 850° F. for a period of time sufficient to convert the slurry into a homogeneous composition which has a flowable heavy oil or pitch-like consistency at 25° C.

By the term "thermally stable" refinery petroleum fractions is meant a highly aromatic residuum such as fluidized catalytic converter (FCC) "main column" bottoms or thermofor catalytic converter (TCC) "syntower" bottoms which contain a substantial proportion of polycyclic aromatic hydrocarbon constituents such as naphthalene, dimethylnaphthalene, anthracene, phenanthrene, fluorene, chrysene, pyrene, perylene, diphenyl, benzothiophene, and the like. Such refractory petroleum media are resistant to conversion to lower molecular products by conventional non-hydrogenative procedures. Typically, these petroleum refinery residua and recycle fractions are hydrocarbonaceous mixtures having an average carbon to hydrogen ratio above about 1:1, and a boiling point above about 450° F.

The petroleum solvents suitable for the practice of the present invention process are thermally stable, highly polycyclic aromatic mixtures which result from one or more petroleum refining operations. Representative heavy petroleum solvents include FCC main tower bottoms; TCC syntower bottoms; asphaltic material; alkane-deasphalted tar; coker gas oil; heavy cycle oil; FCC main tower clarified slurry oil; mixtures thereof, and the like.

The nominal properties of suitable petroleum solvents are as follows:

| | |
|---|---|
| **Syntower Bottoms** | |
| Sulfur | 1.13% |
| Nitrogen | 450 ppm |
| Pour Point | 50° F. |
| Initial Boiling Point | 489° F. |
| 95% Point | 905° F. |
| Conradson Carbon | 9.96 |
| **FCC Clarified Slurry Oil** | |
| Sulfur | 1.04% |
| Nitrogen | 4400 ppm |
| Pour Point | 50° F. |
| Initial Boiling Point | 470° F. |
| 95% Point | 924° F. |
| Conradson Carbon | 10.15 |
| **Heavy Cycle Oil** | |
| Sulfur | 1.12% |
| Nitrogen | 420 ppm |
| Initial Boiling Point | 373° F. |
| 95% Point | 752° F. |
| Conradson Carbon | 10.15 |

An FCC main column bottoms refinery fraction is a highly preferred solvent for the practice of the present invention process. A typical FCC main column bottoms (or FCC clarified slurry oil) contains a mixture of chemical constituents as represented in the following mass spectrometric analysis:

| Compounds | Aromatics | Naphthenic Aromatics | Labile Hz % |
|---|---|---|---|
| Alkyl-Benzenes | 0.4 | | 0 |
| Naphthene-Benzenes | | 1.0 | 0.03 |
| Dinaphthene-Benzenes | | 3.7 | 0.16 |
| Naphthalenes | 0.1 | | 0 |
| Acenaphthenes, (biphenyls) | | 7.4 | 0.08 |
| Fluorenes | | 10.1 | 0.11 |
| Phenanthrenes | 13.1 | | |
| Naphthene-phenanthrenes | | 11.0 | 0.18 |
| Pyrenes, fluoranthenes | 20.5 | | 0 |
| Chrysenes | 10.4 | | 0 |
| Benzofluoranthenes | 6.9 | | 0 |
| Perylenes | 5.2 | | 0 |
| Benzothiophenes | 2.4 | | |
| Dibenzothiophenes | 5.4 | | |
| Naphthobenzothiophenes | | 2.4 | 0.04 |
| Total | 64.4 | 35.6 | 0.60 |

A typical FCC main column bottoms has the following nominal analysis and properties:

| | |
|---|---|
| **Elemental Analysis, Wt. %:** | |
| C | 89.93 |
| H | 7.35 |
| O | 0.99 |
| N | 0.44 |
| S | 1.09 |
| Total | 99.80 |
| **Pour Point, ° F: 50** | |
| **CCR, %: 9.96** | |
| **Distillation:** | |
| IBP, ° F: | 490 |
| 5%, ° F: | 800 (est.) |
| 95%, ° F: | 905 |

FCC main tower bottoms are obtained by the catalytic cracking of gas oil in the presence of a solid porous catalyst. A more complete description of the production of this petroleum fraction is disclosed in U.S. Pat. No. 3,725,240.

A FCC main column bottoms is an excellent liquefaction solvent medium for carbohydrate solubilization because it has a unique combination of physical properties and chemical constituency. A critical aspect of solvating ability is the particular proportions of aromatic and naphthenic and paraffinic moieties characteristic of a prospective liquefaction solvent. A high content of aromatic and naphthenic structures in a solvent is a criterion for high solvating ability for carbohydrate liquefaction.

The solvating ability of a carbohydrate liquefaction solvent can be expressed in terms of specific types of hydrogen content as determined by proton nuclear magnetic resonance spectral analysis. Nuclear magnetic resonance characterization of heavy hydrocarbon oils is well developed. The spectra (60$\mu$ c/sec) are divided into four bonds ($H_\alpha$, $H_\beta$, $H_\gamma$ and $H_{Ar}$) according to the following frequencies in Hertz (Hz) and chemical shift ($\delta$):

| | $H_\alpha$ | $H_\beta$ | $H_\gamma$ | $H_{Ar}$ |
|---|---|---|---|---|
| Hz | 0 - 60 | 60 - 100 | 120 - 200 | 360 - 560 |
| $\delta$ | 0 - 1.0 | 1.0 - 1.8 | 2.0 - 3.3 | 6.0 - 9.2 |

The $H_{Ar}$ protons are attached to aromatic rings and are a measure of aromaticity of a solvent. $H_\alpha$ protons are attached to non-aromatic carbon atoms attached directly to an aromatic ring structure, e.g., alkyl groups and naphthenic ring structures. $H_\beta$ protons are attached to carbon atoms which are in a second position away from an aromatic ring, and $H_\gamma$ protons are attached to carbon atoms which are in a third position or more away from an aromatic ring structure.

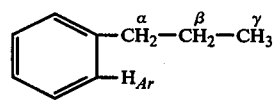

The $H_{Ar}$ protons are important because of their strong solvency power. A high content of $H_\alpha$ protons is particularly significant in a liquefaction solvent, because $H_{60}$ protons are labile and are potential hydrogen donors in a carbohydrate liquefaction process. $H_\beta$ and $H_\gamma$ protons are paraffinic in nature and do not contribute to the solvating ability of a liquefaction solvent.

It is particularly preferred that the FCC main column bottoms employed as a carbohydrate liquefaction solvent in the present invention process has a hydrogen content distribution in which the $H_{Ar}$ proton content is between about 30 and 50 percent, the $H_\alpha$ proton content is at least about 30 percent and the $H_\alpha/H_\beta$ proton ratio is above about 1.4. Concomitantly it is desirable that the $H_\beta$ proton content is below 20 percent and the $H_\gamma$ proton content is below 13 percent.

As it is apparent, the carbohydrate solubilization reaction is promoted by the presence of reactive hydrogen. The requisite hydrogen is provided in the form of labile hydrogen in the petroleum solvent which is transferred to the carbohydrate material during solubilization, and/or the hydrogen is provided in the form of reducing gas introduced into the system. The stoichiometry of the hydrogen transfer might be represented as follows:

$$4(C_6H_{10}O_5)_n + 12H_2 \rightarrow C_6H_{14} + C_{12}H_{26} + 4CO + 2CO_2 + 12H_2O$$

The solid organic materials, i.e., cellulosics and other carbohydrates, amenable to the present invention process are readily available in abundant supply in the form of accumulated municipal, industrial and agricultural waste products.

Carbohydrate agricultural wastes are derived in the form of wheat straw, rice straw, rye straw, maize husks and stalks, sugar cane bagasse, and the like.

Municipal waste organic materials include refuse and sewage sludge. The composition of municipal refuse consists substantially of carbohydrate products such as cardboard, newsprint and other forms of paper. Excluding moisture, metals and siliceous materials, the carbohydrate content of municipal refuse is usually above 90 percent. Table I illustrates the content of a typical municipal refuse composition. The Table I data is by Kaiser, E. R., "Refuse Reduction Process" reported in "Proceedings, the Surgeon General's Conference on Solid Waste Management for Metropolitan Washington", U.S. Public Health Service Publication No. 1729, Government Printing Office, Washington, D.C. July 1967, p. 93.

It is an advantage of the present invention process that the solid carbohydrate waste material being solubilized does not require extensive pretreatment before admixture with the highly aromatic solvent liquefaction medium. A solid urban waste or agricultural waste is subjected to a shredding and macerating procedure and then introduced directly into the invention liquefaction system.

In the invention process, moisture can be removed as an overhead stream, or as an easily separated immiscible liquid phase. A solids phase of inorganics, plastics, textiles and other insoluble constituents of the waste feed composition is readily separated in a settler zone. Any suspended fine solids are removed by centrifugation, filtration, or other conventional solid-liquid separation means.

If more elaborate pretreatment of the solid waste feed is advantageous, a gross separation of combustible and non-combustible materials can be effected by methods and equipment known in the art. Suitable solid waste pretreatment systems are described in U.S. Pat. Nos. 3,714,038 and 3,933,577.

In a typical pretreatment procedure, solid waste is admixed with water and subjected to a pulping action. The effluent slurry is then passed through liquid cyclone and coarse screen zones to remove glass, stone, metal, textile and plastic material, and the like. The pulp slurry is dewatered prior to the present invention liquefaction processing.

TABLE I

EAST COAST MUNICIPAL REFUSE COMPOSITION

| | | | |
|---|---|---|---|
| Cardboard | 7% | Moisture | 28.0% |
| Newspaper | 14 | Carbon | 25.0 |
| Miscellaneous Paper | 25 | Hydrogen | 3.3 |
| Plastic Film | 2 | Oxygen | 21.1 |
| Leather, molded plastics, rubber | 2 | Nitrogen | 0.5 |
| Garbage | 12 | Sulfur | 0.1 |
| Grass and dirt | 10 | Glass, Ceramics, etc. | 9.3 |
| Textiles | 3 | Metals | 7.2 |
| Wood | 7 | Ash, other insects | 5.5 |
| Glass, Ceramics, Stone | 10 | Total | 100.0 |
| Metallics | 8 | | |
| Total | 100.0 | | |

In the invention process, the thermally stable, highly aromatic petroleum component performs as a solvent medium with respect to the solubilization of the solid carbohydrate waste feed. The petroleum solvent and solid waste components are admixed to form a slurry. The slurry thus formed is heated at a temperature in the range between about 350° F. and 850° F., and preferably at a temperature between about 500° F. and 750° F. In the invention process, it is not required to employ a closed system under moderate or high pressures. Nor is it necessary to contact the liquefaction medium with a reducing gas such as hydrogen or synthesis gas. The present invention process can be conducted in an open reactor system at atmospheric pressure, and without the use of catalysts or promoters.

In the invention process, the slurry is heated for a reaction time sufficient to yield a heavy oil or pitch-like composition which upon cooling to ambient temperatures remains homogeneous and has a flowable consistency. The heating step of the invention process is conducted for a period of time between 0.2 and 3 hours, and preferably for a period of time between about 0.5 and 1.5 hours. Although it is not essential, the liquefaction reaction can be conducted under pressure and/or in the presence of a reducing gas (e.g., under a hydrogen or carbon monoxide pressure of about 100–2000 psi).

The petroleum solvent component in the liquefaction reaction mixture is provided in a quantity between about 0.5 and 10 parts by weight per part by weight of the comminuted solid waste component. Normally, the preferred ratio will be in the range between about 1.0 and 5 parts by weight of petroleum solvent per part by weight of solid waste.

At the conclusion of the carbohydrate solubilization step, heavy solids can be removed in a settler, and if desired, suspended solids can be separated from the liquefaction medium by centrifugation or filtration.

The homogeneous heavy oil or bitumen compositions which are the resultant products of the present invention process can be directly utilized as liquid fuel, such as in heavy oil fired stationary power generators. It is an important advantage of the present invention that the preferred compositions which are produced meet the specifications of No. 6 fuel oil. If desired, the invention compositions can be deashed (e.g., by filtration, centrifugation, selective precipitation, and the like) as previously described to yield a fuel which meets the specifications of the more valuable No. 5 fuel oil.

It is also within the scope of this invention to modify the physical properties of the homogeneous heavy oil or bitumen compositions by one or more additional procedures. For example, cutting stock can be added in variable proportions to change the flow characteristics of the compositions. Suitable cutting stocks include kerosene and light gas oil fractions. The compositions can be diluted with cutting stocks over a broad range of between about 0.1 and 10 volumes of cutting stock per volume of invention composition. The inclusion of cutting stock facilitates filtration or other separation means employed to separate the solids phase of ash and other insoluble materials from the fluid liquefaction phase.

It is another embodiment of this invention to subject the products of the invention process to modification by steps which include (1) deashing and the removal of other insoluble solids; and (2) removal of the petroleum solvent component by distillation to yield solvent-refined hydrocarbonaceous derivatives.

It is a further embodiment of this invention to subject the recovered heavy oil or bitumen products to petroleum refinery upgrading to premium motor fuels.

The following example is further illustrative of the present invention. The reactants and other specific ingredients are presented as being typical, and various modifications can be derived in view of the foregoing disclosure within the scope of the invention.

EXAMPLE

Waste newsprint was comminuted and solubilized in a FCC main column bottoms in accordance with the present invention process. The reaction conditions and the product yields of the process were as follows:

| | Paper |
|---|---|
| Operating Conditions | |
| Temperature, ° F | 600 |
| Time, hours | 1 |
| Initial Press, psig | 0 |
| Solvent/Feed, wt/wt | 3/2 |
| Conversion, wt %[a] | 94 |
| Product Yield, wt %[b] | |
| Benzene Soluble | 10.0 |
| Benzene Insoluble | 42.6 |
| (Liquid Product) | (52.6) |
| Gas | 14.3 |
| Water | 27.2 |
| Unreacted | 5.9 |
| | 100.0 |

[a]m.a.f. paper or wood.
[b]calculated on solvent-free basis.

What is claimed is:

1. A process for liquefaction of solid carbohydrate waste material without the use of high pressures or reducing gases or catalysts which comprises forming a slurry by admixing comminuted carbohydrate waste with a highly aromatic refinery petroleum residuum solvent having a boiling point between about 450° F. and 1100° F, wherein said petroleum residuum solvent has a hydrogen content distribution in which the $H_{Ar}$ proton content is between about 30 and 50 percent, the $H_\alpha$ proton content is at least 30 percent and the $H_\alpha/H_\beta$ proton ratio is above about 1.4, and heating said slurry at a temperature in the range between about 350° F. and 850° F. for a period of time sufficient to convert the slurry into a homogeneous hydrocarbonaceous composition which has a flowable heavy oil or bitumen consistency at 25° C.

2. A process in accordance with claim 1 wherein the petroleum residuum solvent is provided in a quantity between about 0.5 and 10 parts by weight per part by weight of the comminuted carbohydrate waste material.

3. A process in accordance with claim 1 wherein the petroleum residuum solvent is a FCC main column bottoms.

4. A process in accordance with claim 1 wherein the petroleum residuum solvent is a TCC syntower bottoms.

5. A process in accordance with claim 1 wherein the solid carbohydrate waste is municipal refuse.

6. A process in accordance with claim 1 wherein the solid carbohydrate waste is municipal sewage sludge.

7. A process in accordance with claim 1 wherein the solid carbohydrate waste is agricultural cellulosic by-product.

8. A process in accordance with claim 1 wherein the solid carbohydrate waste is newsprint and cardboard.

* * * * *

UNITED STATES PATENT AND TRADEMARK OFFICE

CERTIFICATE OF CORRECTION

PATENT NO. : 4,145,188

DATED : March 20, 1979

INVENTOR(S) : WILTON F. ESPENSCHEID and TSOUNG YIAN YAN

It is certified that error appears in the above-identified patent and that said Letters Patent are hereby corrected as shown below:

Column 3 Line 27 - "Labile Hz% " should read -- Labile $H_2$% --

Column 4 Line 37 - "because $H_{60}$" should read -- because $H_{\alpha}$ --

Signed and Sealed this

*Twenty-fourth* Day of *July 1979*

[SEAL]

*Attest:*

*Attesting Officer*

LUTRELLE F. PARKER

*Acting Commissioner of Patents and Trademarks*